US007350582B2

(12) United States Patent
McKeachnie et al.

(10) Patent No.: US 7,350,582 B2
(45) Date of Patent: Apr. 1, 2008

(54) WELLBORE TOOL WITH DISINTEGRATABLE COMPONENTS AND METHOD OF CONTROLLING FLOW

(75) Inventors: W. John McKeachnie, Vernal, UT (US); Michael McKeachnie, Vernal, UT (US); Scott Williamson, Castle Rock, CO (US); Rocky A. Turley, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 242 days.

(21) Appl. No.: 11/018,406

(22) Filed: Dec. 21, 2004

(65) Prior Publication Data

US 2006/0131031 A1 Jun. 22, 2006

(51) Int. Cl.
*E21B 34/08* (2006.01)

(52) U.S. Cl. ..... 166/373; 166/376; 166/387; 166/317; 166/318; 166/194

(58) Field of Classification Search ..... 166/317, 166/376, 383, 332.4, 318, 134, 152, 105.5, 166/387, 194, 373, 374
See application file for complete search history.

(56) References Cited

U.S. PATENT DOCUMENTS

| | | | | |
|---|---|---|---|---|
| 2,238,895 A | | 4/1941 | Gage et al. | |
| 2,672,199 A | * | 3/1954 | McKenna | 166/134 |
| 3,497,003 A | * | 2/1970 | Kisling et al. | 166/134 |
| 3,645,331 A | | 2/1972 | Maurer et al. | |
| 5,333,684 A | * | 8/1994 | Walter et al. | 166/105.5 |
| 5,335,727 A | * | 8/1994 | Cornette et al. | 166/387 |
| 5,417,285 A | | 5/1995 | Van Buskirk et al. | |
| 5,479,986 A | | 1/1996 | Gano et al. | |
| 5,607,017 A | | 3/1997 | Owens et al. | |
| 5,685,372 A | | 11/1997 | Gano | |
| 5,765,641 A | | 6/1998 | Shy et al. | |
| 5,941,309 A | * | 8/1999 | Appleton | 166/317 |
| 6,189,618 B1 | | 2/2001 | Beeman et al. | |
| 6,220,350 B1 | | 4/2001 | Brothers et al. | |
| 6,540,033 B1 | | 4/2003 | Sullivan et al. | |
| 6,752,209 B2 | * | 6/2004 | Mondelli et al. | 166/152 |

OTHER PUBLICATIONS

CA Office Action, Application No. 2,528,694, Dated Apr. 12, 2007.

* cited by examiner

*Primary Examiner*—Richard E. Chilcot, Jr.
*Assistant Examiner*—Matthew J. Smith
(74) *Attorney, Agent, or Firm*—Patterson & Sheridan, LLP

(57) ABSTRACT

The present invention generally provides a pressure isolation plug for managing a wellbore with multiple zones. The pressure isolation plug generally includes a body with a bore extending therethrough, a first disintegratable ball sized and positioned to restrict upward fluid flow through the bore, wherein the disintegratable ball disintegrates when exposed to wellbore conditions for a first amount of time. The plug also includes a second ball sized and positioned to restrict downward fluid flow through the bore.

15 Claims, 5 Drawing Sheets

WELLBORE TOOL WITH DISINTEGRATABLE COMPONENTS AND METHOD OF CONTROLLING FLOW

BACKGROUND OF THE INVENTION

1. Field of the Invention

Embodiments of the present invention are generally related to oil and gas drilling. More particularly, embodiments of the present invention pertain to pressure isolation plugs that utilize disintegratable components to provide functionality typically offered by frac plugs and bridge plugs.

2. Description of the Related Art

An oil or gas well includes a wellbore extending into a well to some depth below the surface. Typically, the wellbore is lined with a string of tubulars, such as casing, to strengthen the walls of the borehole. To further reinforce the walls of the borehole, the annular area formed between the casing and the borehole is typically filled with cement to permanently set the casing in the wellbore. The casing is then perforated to allow production fluid to enter the wellbore from the surrounding formation and be retrieved at the surface of the well.

Downhole tools with sealing elements are placed within the wellbore to isolate the production fluid or to manage production fluid flow into and out of the well. Examples of such tools are frac plugs and bridge plugs. Frac plugs (also known as fracturing plugs) are pressure isolation plugs that are used to sustain pressure due to flow of fluid that is pumped down from the surface. As their name implies, frac plugs are used to facilitate fracturing jobs. Fracturing, or "fracing", involves the application of hydraulic pressure from the surface to the reservoir formation to create fractures through which oil or gas may move to the well bore. Bridge plugs are also pressure isolation devices, but unlike frac plugs, they are configured to sustain pressure from below the plug. In other words, bridge plugs are used to prevent the upward flow of production fluid and to shut in the well at the plug. Bridge plugs are often run and set in the wellbore to isolate a lower zone while an upper section is being tested or cemented.

Frac plugs and bridge plugs that are available in the marketplace typically comprise components constructed of steel, cast iron, aluminum, or other alloyed metals. Additionally, frac plugs and bridge plugs include a malleable, synthetic element system, which typically includes a composite or synthetic rubber material which seals off an annulus within the wellbore to restrict the passage of fluids and isolate pressure. When installed, the element system is compressed, thereby expanding radially outward from the tool to sealingly engage a surrounding tubular. Typically, a frac plug or bridge plug is placed within the wellbore to isolate upper and lower sections of production zones. By creating a pressure seal in the wellbore, bridge plugs and frac-plugs isolate pressurized fluids or solids. Operators are taking advantage of functionality provided by pressure isolation devices such as frac plugs and bridge plugs to perform a variety of operations (e.g., cementation, liner maintenance, casing fracs, etc.) on multiple zones in the same wellbore—such operations require temporary zonal isolation of the respective zones.

For example, for a particular wellbore with multiple (i.e., two or more) zones, operators may desire to perform operations that include: fracing the lowest zone; plugging it with a bridge plug and then fracing the zone above it; and then repeating the previous steps until each remaining zone is fraced and isolated. With regards to frac jobs, it is often desirable to flow the frac jobs from all the zones back to the surface. This is not possible, however, until the previously set bridge plugs are removed. Removal of conventional pressure isolation plugs (either retrieving them or milling them up) usually requires well intervention services utilizing either threaded or continuous tubing, which is time consuming, costly and adds a potential risk of wellbore damage.

Certain pressure isolation plugs developed that hold pressure differentials from above while permitting flow from below. However, too much flow from below will damage the ball and seat over time and the plug will not hold pressure when applied from above.

There is a need for a pressure isolation device that temporarily provides the pressure isolation of a frac plug or bridge plug, and then allows unrestricted flow through the wellbore. One approach is to use disintegratable materials that are water-soluble. As used herein, the term "disintegratable" does not necessarily refer to a material's ability to disappear. Rather, "disintegratable" generally refers to a material's ability to lose its structural integrity. Stated another way, a disintegratable material is capable of breaking apart, but it does not need to disappear. It should be noted that use of disintegratable materials to provide temporary sealing and pressure isolation in wellbores is known in the art. For some operations, disintegratable balls constructed of a water-soluble composite material are introduced into a wellbore comprising previously created perforations. The disintegratable balls are used to temporarily plug up the perforations so that the formation adjacent to the perforations is isolated from effects of the impending operations. The material from which the balls are constructed is configured to disintegrate in water at a particular rate. By controlling the amount of exposure the balls have to wellbore conditions (e.g., water and heat), it is possible to plug the perforations in the above manner for a predetermined amount of time.

It would be advantageous to configure a pressure isolation device or system to utilize these disintegratable materials to temporarily provide the pressure isolation of a frac plug or bridge plug, and then provide unrestricted flow. This would save a considerable amount of time and expense. Therefore, there is a need for an isolation device or system that is conducive to providing zonal pressure isolation for performing operations on a wellbore with multiple production zones. There is a further need for the isolation device or system to maintain differential pressure from above and below for a predetermined amount of time.

SUMMARY OF THE INVENTION

One embodiment of the present invention provides a method of operating a downhole tool. The method generally includes providing the tool having at least one disintegratable ball seatable in the tool to block a flow of fluid therethrough in at least one direction, causing the ball to seat and block the fluid, and permitting the ball to disintegrate after a predetermined time period, thereby reopening the tool to the flow of fluid.

Another embodiment of the present invention provides a method of managing a wellbore with multiple zones. The method generally includes providing a pressure isolation plug, utilizing a first disintegratable ball to restrict upward flow and isolate pressure below the pressure isolation plug, utilizing a second disintegratable ball to restrict downward flow and isolate pressure above the pressure isolation plug, exposing the first disintegratable ball and the second disintegratable ball to wellbore conditions for a first amount of time, causing the first disintegratable ball to disintegrate, and allowing upward flow to resume through the pressure isolation plug Another embodiment of the present invention provides a method of managing a wellbore with multiple zones. The method generally includes providing a pressure isolation plug, utilizing a disintegratable ball to restrict upward fluid flow and isolate pressure below the pressure isolation plug, exposing the ball to wellbore conditions including water and heat, thereby allowing the ball to disintegrate, and allowing upward fluid flow to resume through the pressure isolation plug.

Another embodiment of the present invention provides an apparatus for managing a wellbore with multiple zones. The apparatus generally includes a body with a bore extending therethrough, and a disintegratable ball sized to fluid flow through the bore, wherein the disintegratable ball disintegrates when exposed to wellbore conditions for a given amount of time.

Another embodiment of the present invention provides an apparatus for managing a wellbore with multiple zones. The apparatus generally includes a body with a bore extending therethrough, a first disintegratable ball sized and positioned to restrict upward fluid flow through the bore, wherein the disintegratable ball disintegrates when exposed to wellbore conditions for a first amount of time. The apparatus also includes a second ball sized and positioned to restrict downward fluid flow through the bore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The apparatus and methods of the present invention include subsurface pressure isolation plugs for use in wellbores. Embodiments of the present invention provide pressure isolation plugs that utilize disintegratable components to provide functionality typically offered by frac plugs and bridge plugs. The plugs are configured to provide such functionality for a predetermined amount of time. It should be noted that while utilizing pressure isolation plugs of the present invention as frac plugs and bridge plugs is described herein, they may also be used as other types of pressure isolation plugs.

Figure 1:
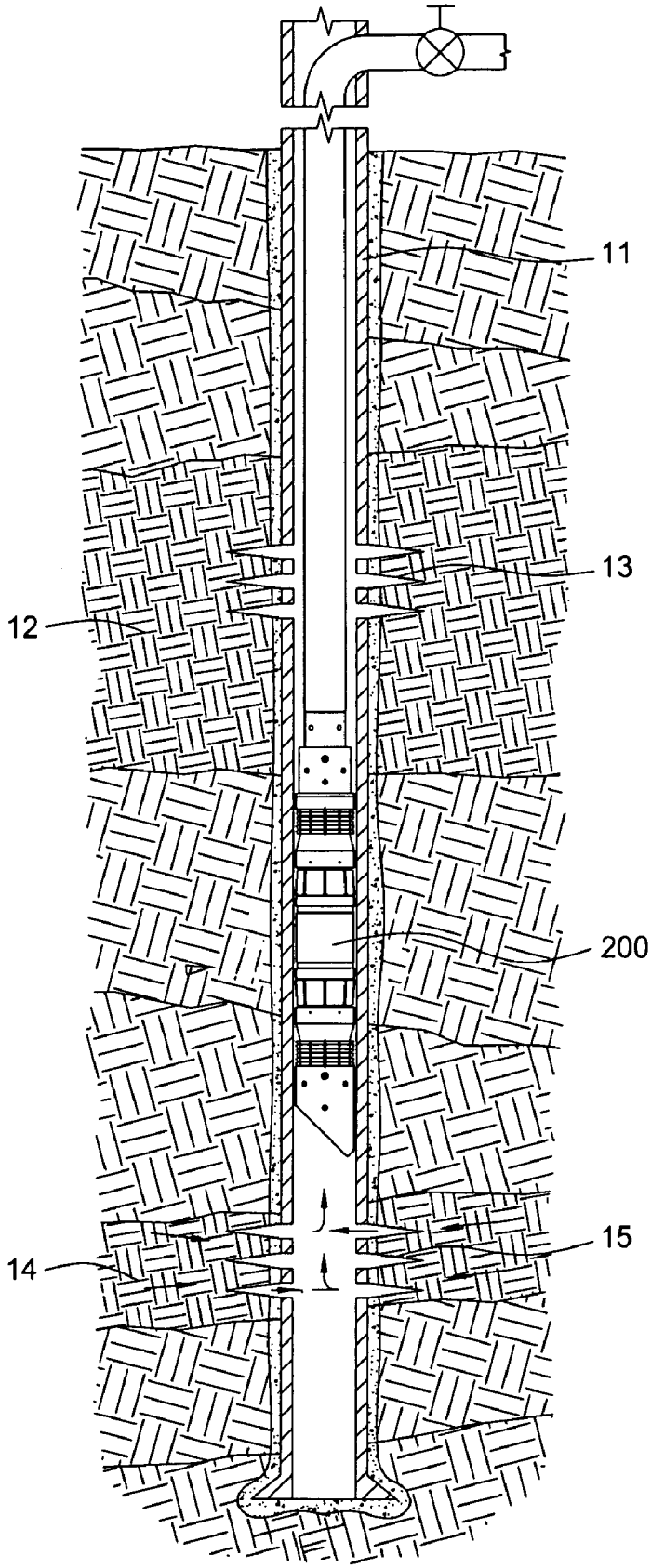
FIG. 1 is a cross-sectional view of a wellbore illustrating a string of tubulars having a pressure isolation plug in accordance with one embodiment of the present invention.

FIG. 1 is a cross-sectional view of a wellbore 10 illustrating a string of tubulars 11 having an pressure isolation plug 200 in accordance with one embodiment of the present invention. The string of tubulars may be a string of casing or production tubing extending into the wellbore from the surface. As will be described in detail below, the pressure isolation plug 200 may be configured to used as a frac plug, bridge plug or both. Accordingly, the pressure isolation plug 200, also referred to herein as simply "plug" 200, may isolate pressure from above, below or both. For instance, as seen in FIG. 1, if the plug is configured to function as a frac plug, it isolates pressure from above and facilitates the fracing of the formation 12 adjacent to perforations 13. If the plug 200 is configured to function as a bridge plug, production fluid from formation 14 entering the wellbore 10 from the corresponding perforations 15 is restricted from flowing to the surface.

The pressure isolation plug according to embodiments of the present invention may be used as frac plugs and bridge plugs by utilizing disintegratable components, such as balls, used to stop flow through a bore of the plug 200. The balls can be constructed of a material that is disintegratable in a predetermined amount of time when exposed to particular wellbore conditions. The disintegratable components and the methods in which they are used are described in more detail with reference to FIGS. 2, 3 and 4.

Figure 2:
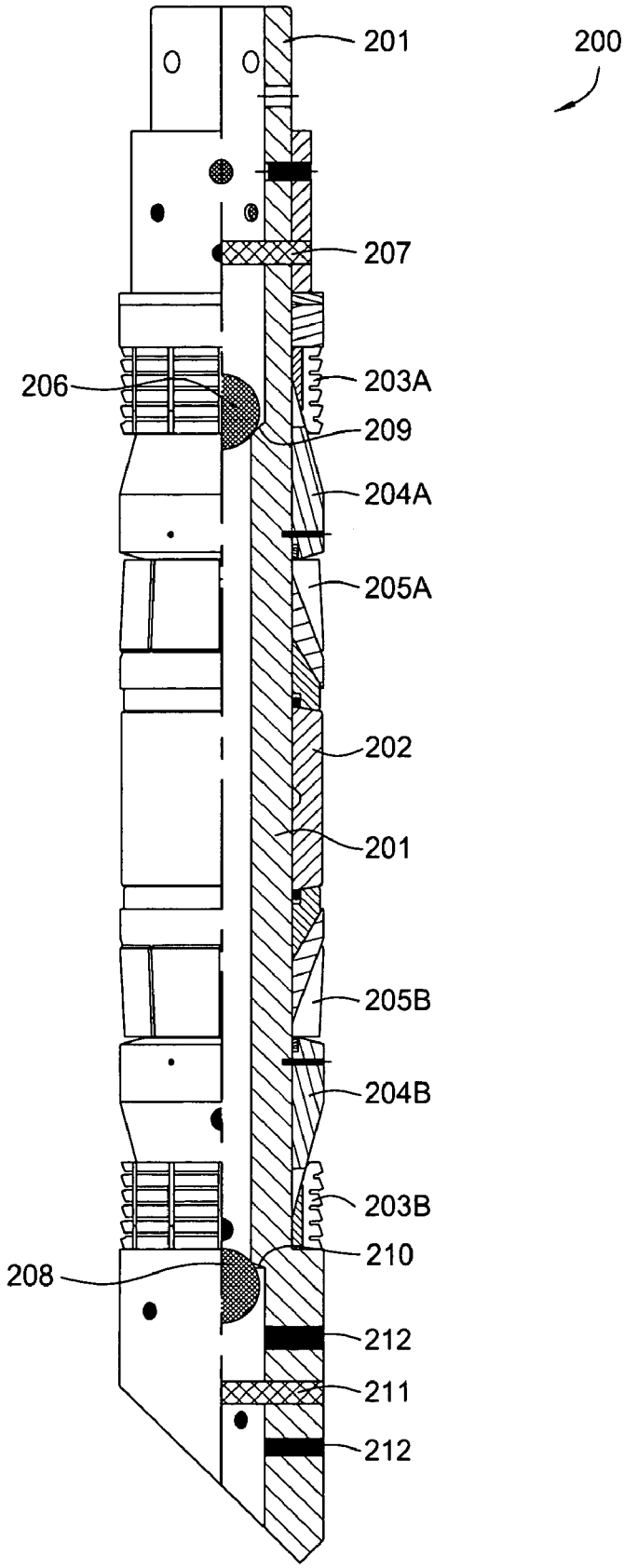
FIG. 2 is a detailed cross-sectional view of a pressure isolation plug in accordance with one embodiment of the present invention.

FIG. 2 is a detailed cross sectional view of a pressure isolation plug 200. The plug 200 generally includes a mandrel 201, a packing element 202 used to seal an annular area between the plug 200 and an inner wall of the tubular string 11 therearound (not shown), and one or more slips 203A and 203B. The packing element 202 is disposed between upper and lower retainers 205A and 205B. In operation, axial forces are applied to the upper slip 203A while the mandrel 201 and the lower slip 203B are held in a fixed position. As the upper slip 203A moves down in relation to the mandrel 201 and lower slip 203B, the packing element 202 is actuated and the upper slip 203A and lower slip 203B are driven up cones 204A and 204B, respectively. The movement of the cones and the slips axially compress and radially expand the packing element 202 thereby forcing the sealing portion radially outward from the plug 200 to contact the inner surface of the tubular string 11. In this manner, the compressed packing element 202 provides a fluid seal to prevent movement of fluids across the plug 200 via the annular gap between the plug 200 and the interior of the tubular string 11, thereby facilitating pressure isolation.

Application of the axial forces that are required to set the plug 200 in the manner described above may be provided by a variety of available setting tools well known in the art. The selection of a setting tool may depend on the selected conveyance means, such as wireline, threaded tubing or continuous tubing. For example, if the plug 200 is run into position within the wellbore on wireline, a wireline pressure setting tool may be used to provide the forces necessary to urge the slips over the cones, thereby actuating the packing element 202 and setting the plug 200 in place.

Upon being set in the desired position within the wellbore 10, a pressure isolation plug 200, configured as shown in FIG. 2, is ready to function as a bridge plug and a frac plug. Upward flow of fluid (presumably production fluid) causes the lower ball 208 to seat in the lower ball seat 210, which allows the plug 200 to restrict upward flow of fluid and isolate pressure from below. This allows the plug 200 to provide the functionality of a conventional bridge plug. It should be noted that in the absence of upward flow, the lower ball 208 is retained within the plug 200 by retainer pin 211. Downward flow of fluid causes the upper ball 206 to seat in the upper ball seat 209, thereby allowing the plug 200 to restrict downward flow of fluid and isolate pressure from above; this allows the plug to function as a conventional frac plug, which allows fracturing fluid to be directed into the formation through the perforations. Stated another way, the upper ball 206 acts as a one-way check valve allowing fluid to flow upwards and the lower ball 208 acts as a one-way check valve allowing fluid to flow downwards.

As described earlier, for some wellbores with multiple (i.e., two or more) zones, operators may desire to perform operations that include fracing of multiple zones. Exemplary operations for setting the plug 200 and proceeding with the frac jobs are provided below. First, the plug 200 is run into the wellbore via a suitable conveyance member (such as wireline, threaded tubing or continuous tubing) and positioned in the desired location. In a live well situation, while the plug 200 is being lowered into position, upward flow is diverted around the plug 200 via ports 212. Next, the plug 200 is set using a setting tool as described above. Upon being set, the annular area between the plug 200 and the surrounding tubular string 11 is plugged off and the upward flow of production fluid is stopped as the lower ball 208 seats in the ball seat 210. Residual pressure remaining above the plug 200 can be bled off at the surface, enabling the frac job to begin. Downward flow of fracing fluid ensures that the upper ball 206 seats on the upper ball seat 209, thereby allowing the frac fluid to be directed into the formation through corresponding perforations. After a predetermined amount of time, and after the frac operations are complete, the production fluid is allowed to again resume flowing upward through the plug 200, towards the surface. The upward flow is facilitated by the disintegration of the lower ball 208 into the surrounding wellbore fluid. The above operations can be repeated for each zone that is to be fraced.

For some embodiments the lower ball 208 is constructed of a material that is designed to disintegrate when exposed to certain wellbore conditions, such as temperature, water and heat pressure and solution. The heat may be present due to the temperature increase attributed to the natural temperature gradient of the earth, and the water may already be present in the existing wellbore fluids. The disintegration process completes in a predetermined time period, which may vary from several minutes to several weeks. Essentially all of the material will disintegrate and be carried away by the water flowing in the wellbore. The temperature of the water affects the rate of disintegration. The material need not form a solution when it dissolves in the aqueous phase, provided it disintegrates into sufficiently small particles, i.e., a colloid, that can be removed by the fluid as it circulates in the well. The disintegratable material is preferably a water soluble, synthetic polymer composition including a polyvinyl, alcohol plasticizer and mineral filler. Disintegratable material is available from Oil States Industries of Arlington, Tex., U.S.A.

Figure 3:
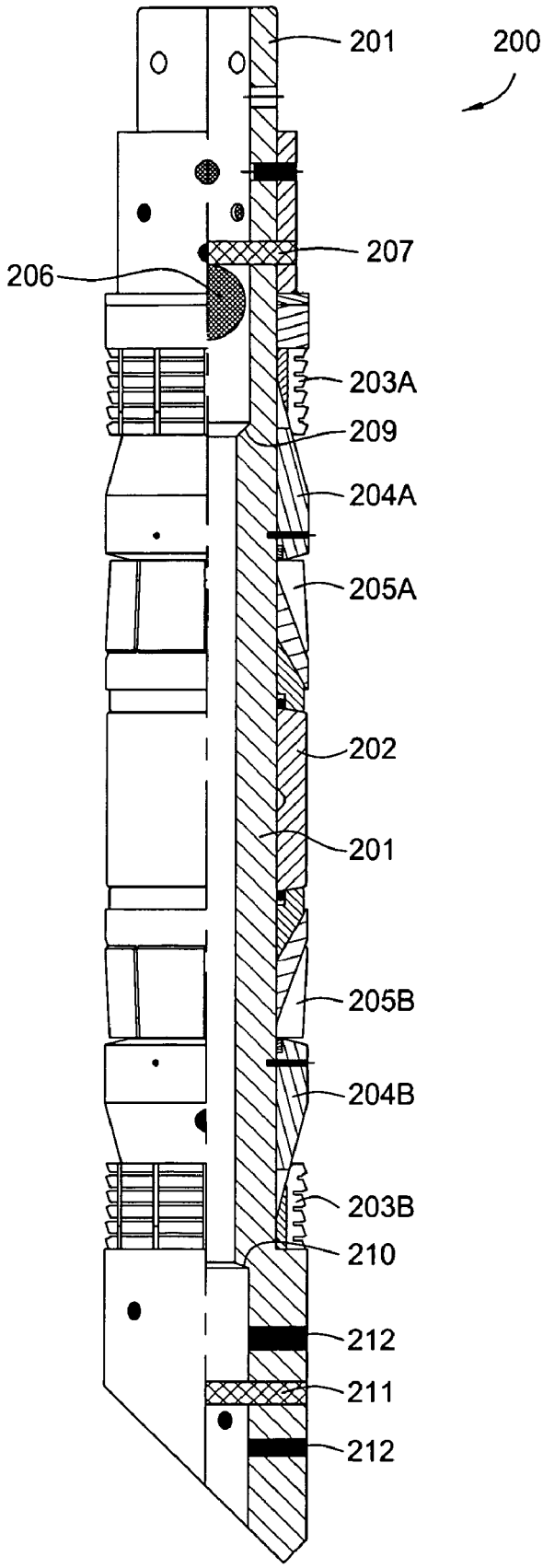
FIG. 3 is another detailed cross-sectional view of the pressure isolation plug shown in FIG. 2.

Referring now to FIG. 3, which illustrates the plug 200 of FIG. 2 after the lower ball 208 has disintegrated. The upper ball 206 remains intact but still allows the production fluid to flow to the surface—the upward flow of fluid disengages the upper ball 206 from the upper ball seat 209. A retainer pin 207 is provided to constrain the upward movement of the ball 206. Essentially, FIG. 3 illustrates the plug 200 providing the functionality of a conventional frac plug. During a frac job, downward flow of fluid would cause the upper ball 206 to seat and the plug 200 would allow fracturing fluid to be directed into the formation above the plug 200 via the corresponding perforations.

The presence of the upper ball 206 ensures that if another frac operation is required, downward flow of fluid will again seat the upper ball 206 and allow the frac job to commence. With regard to the upper ball 206, if it is desired that the ball persist indefinitely (i.e., facilitate future frac jobs), the upper ball 206 may be constructed of a material that does not disintegrate. Such materials are well known in the art. However, if the ability to perform future frac jobs using the plug 200 is not desired, both the lower ball and the upper ball may be constructed of a disintegratable material.

Accordingly, for some embodiments, the upper ball 206 is also constructed of a disintegratable material. There are several reasons for providing a disintegratable upper ball 206, including: it is no longer necessary to have the ability to frac the formation above the plug; disintegration of the ball yields an increase in the flow capacity through the plug 200. It should be noted that if the upper ball 206 is disintegratable too, it would have to disintegrate at a different rate from the lower ball 208 in order for the plug 200 to provide the functionality described above. The upper and lower balls would be constructed of materials that disintegrate at different rates.

Figure 4:
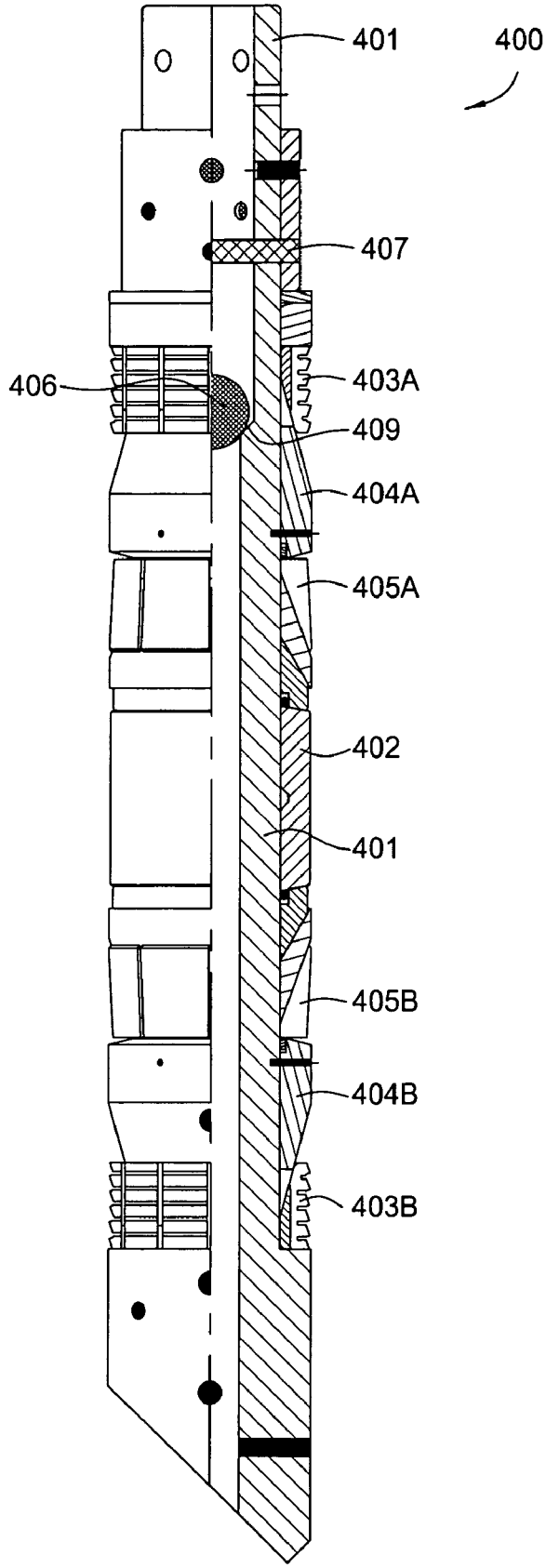
FIG. 4 is a detailed cross-sectional view of a pressure isolation plug in accordance with an alternative embodiment of the present invention.
Figure 5:
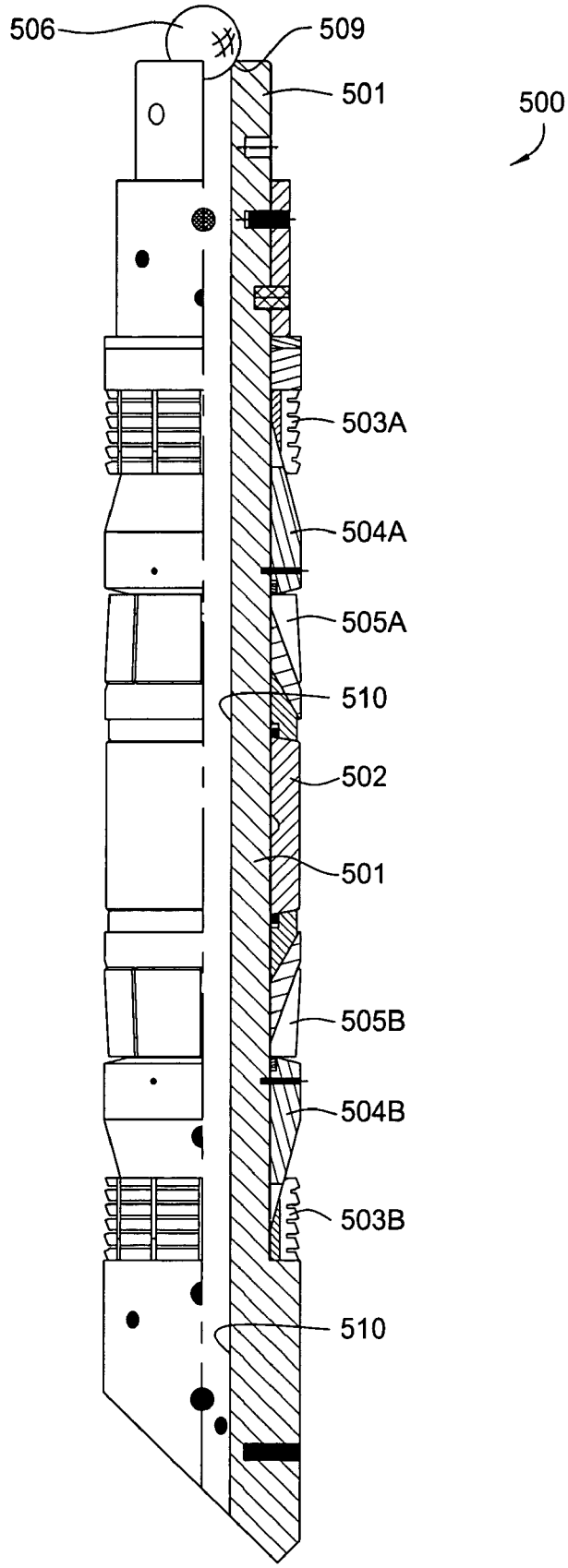
FIG. 5 is a detailed cross-sectional view of a pressure isolation plug in accordance with yet another embodiment of the present invention.

While the pressure isolation plug of FIG. 2 has the capability to sustain pressure from both directions, other embodiments may be configured for sustaining pressure from a single direction. In other words, the plug could be configured to function as a particular type of plug, such as a frac plug or a bridge plug. FIGS. 4 and 5 illustrate embodiments of the invention that only function as frac plugs. Both embodiments are configured to isolate pressure only from above; accordingly, each is provided with only one ball. The disintegratable balls included with each embodiment may be constructed of a suitable water soluble material so that after a predetermined amount of time (presumably after the fracing is done), the balls will disintegrate and provide an unobstructed flow path through the plug for production fluid going towards the surface. As stated earlier, these types of plugs are advantageous because they allow for frac jobs to be performed, but also allow unrestricted flow after a predetermined amount of time, without the need of additional operations to manipulate or remove the plug from the wellbore.

With regards to the embodiments shown in FIGS. 4 and 5, the packing element, retainers, cones and slips shown in each figure are identical in form and function to those described with reference to FIG. 2. Therefore, for purposes of brevity they are not described again. As can be seen, the primary differences are the number of disintegratable balls (these embodiments only have one) and the profile of the bore of the respective mandrels.

With reference to FIG. 4, plug 400 comprises a mandrel 401 with a straight bore 410 that extends therethrough. With downward flow (i.e., pressure from above), the frac ball 406 lands on a seat 409 and isolates the remainder of the wellbore below the plug 400 from the fluid flow and pressure above the plug 400. As with FIG. 2, during upward flow, the ball 406 is raised off the seat and is constrained by retainer pin 407. While this embodiment keeps the ball 406 secure within the body of the tool, the flow area for production fluid is limited to the annular area of the bore of the mandrel 401 minus the cross-sectional area of the ball 406.

The plug 500 illustrated in FIG. 5 provides more flow area for the upward moving production fluid, which yields higher flow capacity than the plug described with reference to FIG.

4. This configuration of the plug (shown in FIG. 5) provides a larger flow area because the ball 506 can be urged upwards and away from the ball seat 509 by the upward flow of the production fluid. In fact, the ball 506 is carried far enough upward so that it no longer affects the upward flow of the production fluid. The resulting flow through the plug 500 is equal to the cross-sectional area corresponding to the internal diameter of the mandrel 501. As with the previous embodiments, when there is downward fluid flow, such as during a frac operation, the ball 506 again lands on the ball seat 509 and isolates the wellbore below the plug 500 from the fracing fluid above.

With reference to FIG. 4, plug 400 comprises a mandrel 401 with a straight bore 410 that extends therethrough. With downward flow (i.e., pressure from above), the frac ball 406 lands on a seat 409 and isolates the remainder of the wellbore below the plug 400 from the fluid flow and pressure above the plug 400. As with FIG. 2, during upward flow, the ball 406 is raised off the seat and is constrained by retainer pin 407. While this embodiment keeps the ball 406 secure within the body of the tool, the flow area for production fluid is limited to the annular area of the bore of the mandrel 401 minus the cross-sectional area of the ball 406. As shown in FIG. 4. the plug 400 generally includes the mandrel 401, a packing element 402 used to seal an annular area between the plug 400, and an inner wall of the tubular string 11 therearound (not shown), one or more slips 403A and 403B and one or more cones 404A and 404B. The packing element 402 is disposed between upper and lower retainers 405A and 405B.

The plug 500 illustrated in FIG. 5 provides more flow area for the upward moving production fluid, which yields higher flow capacity than the plug described with reference to FIG. 4. This configuration of the plug (shown in FIG. 5) provides a larger flow area because the ball 506 can be urged upwards and away from the ball seat 509 by the upward flow of the production fluid. In fact, the ball 506 is carried far enough upward so that it no longer affects the upward flow of the production fluid. The resulting flow through the plug 500 is equal to the cross-sectional area corresponding to the internal diameter of the mandrel 501. As with the previous embodiments, when there is downward fluid flow, such as during a frac operation, the ball 506 again lands on the ball seat 509 and isolates the wellbore below the plug 500 from the fracing fluid above. As shown in FIG. 5, the plug 500 generally includes the mandrel 501, a bore 510, a packing element 502 used to seal an annular area between the plug 500, and an inner wall of the tubular string 11 therearound (not shown), one or more slips 503A and 503B and one or more cones 504A and 504B. The packing element 502 is disposed between upper and lower retainers 505A and 505B.

In some embodiments, the disintegratable balls described above may be constructed of materials that will disintegrate only when exposed to a particular chemical that is pumped down from the surface. In other words, wellbore conditions, such as the presence of water and heat may not be sufficient to invoke the disintegration of the balls.

While the foregoing is directed to embodiments of the present invention, other and further embodiments of the invention may be devised without departing from the basic scope thereof, and the scope thereof is determined by the claims that follow.

The invention claimed is:

1. A method of operating a downhole tool, comprising:

providing the tool having at least one dissolvable ball seatable in the tool to block a flow of fluid therethrough in at least one direction;

causing the ball to seat and block the fluid;

permitting the ball to dissolve after a predetermined time period, thereby reopening the tool to the flow of fluid; and providing a second ball seatable in the tool to block the flow of fluid therethrough in a second direction.

2. The method of claim 1, further comprising providing a dissolvable annular ball seat in the tool.

3. The method of claim 1, wherein the second ball is dissolvable.

4. A method of isolating one section of a wellbore from another, comprising:

providing a pressure isolation plug;

utilizing a first soluble ball to restrict upward flow and isolate pressure below the pressure isolation plug;

utilizing a second soluble ball to restrict downward flow and isolate pressure above the pressure isolation plug;

exposing the first soluble ball and the second soluble ball to wellbore conditions for a first amount of time, causing the first soluble ball to dissolve; and allowing upward flow to resume through the pressure isolation plug.

5. The method of claim 4, the wellbore conditions comprise water and heat.

6. A method of isolating one section of a wellbore from another, comprising:

providing a pressure isolation plug;

utilizing a dissolvable ball to restrict upward fluid flow and isolate pressure below the pressure isolation plug;

exposing the ball to wellbore conditions including water and heat, thereby allowing the ball to dissolve; and allowing upward fluid flow to resume through the pressure isolation plug.

7. The method of claim 6, wherein the wellbore conditions comprise water and heat.

8. An apparatus for isolating one section of a wellbore from another, comprising:

a body with a bore extending therethrough;

a first dissolvable ball sized and positioned to restrict upward fluid flow through the bore, wherein the dissolvable ball dissolves when exposed to wellbore conditions for a first amount of time; and a second ball sized and positioned to restrict downward fluid flow through the bore.

9. The apparatus of claim 8, further comprising a dissolvable annular ball seat.

10. An apparatus for use in a wellbore comprising:

a body; and a slip assembly for fixing the body at a predetermined location in a wellbore the slip assembly arranged to frictionally contact the wellbore walls:

whereby at least one portion of the slip assembly is made of a dissolvable material constructed and arranged to lose its structural integrity after a predetermined amount of time.

11. The apparatus of claim 10, wherein the apparatus is a packer.

12. The apparatus of claim 10, wherein the apparatus is a bridge plug.

13. A method of isolating one section of a wellbore from another, comprising:

providing a pressure isolation plug;

utilizing a first disintegratable ball to restrict upward flow and isolate pressure below the pressure isolation plug;

utilizing a second disintegratable ball to restrict downward flow and isolate pressure above the pressure isolation plug;

exposing the first disintegratable ball and the second disintegratable ball to wellbore conditions for a first amount of time, causing the first disintegratable ball to disintegrate;

exposing the second disintegratable ball to wellbore conditions for a second amount of time, causing the second disintegratable ball to disintegrate; and allowing upward flow to resume through the pressure isolation plug.

14. The method of claim 13, the wellbore conditions comprise water and heat.

15. An apparatus for isolating one section of a wellbore from another, comprising:

a body with a bore extending therethrough;

a first disintegratable ball sized and positioned to restrict upward fluid flow through the bore, wherein the disintegratable ball disintegrates when exposed to wellbore conditions for a first amount of time; and a second ball sized and positioned to restrict downward fluid flow through the bore, wherein the second ball is disintegratable and is configured to disintegrate when exposed to wellbore conditions for a second amount of time.

* * * * *